US011906239B2

(12) United States Patent
Anderson et al.

(10) Patent No.: US 11,906,239 B2
(45) Date of Patent: Feb. 20, 2024

(54) SYSTEMS FOR HEAT LEAK PREVENTION IN REFRIGERATOR APPLIANCES

(71) Applicant: Haier US Appliance Solutions, Inc., Wilmington, DE (US)

(72) Inventors: Ronald Kenneth Anderson, Sidney, OH (US); Zachary Michael Eagleson, Newburgh, IN (US); Martin Busche, Evansville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 50 days.

(21) Appl. No.: 17/728,040

(22) Filed: Apr. 25, 2022

(65) Prior Publication Data

US 2023/0341174 A1 Oct. 26, 2023

(51) Int. Cl.
*F25D 23/06* (2006.01)
*F25D 25/02* (2006.01)

(52) U.S. Cl.
CPC ..... *F25D 23/069* (2013.01); *F25D 25/02* (2013.01); *F25D 2201/10* (2013.01); *F25D 2331/803* (2013.01); *F25D 2400/04* (2013.01)

(58) Field of Classification Search
CPC .... F25D 23/069; F25D 25/02; F25D 2201/10; F25D 2331/803; F25D 2400/04; F25D 2201/12; F25D 23/065; F25D 2400/02; F25D 23/087
See application file for complete search history.

(56) References Cited

U.S. PATENT DOCUMENTS

| | | | |
|---|---|---|---|
| 4,223,538 | A | 9/1980 | Braden et al. |
| 4,335,842 | A | 6/1982 | Bradford et al. |
| 5,638,962 | A | 6/1997 | Price, Jr. et al. |
| D395,954 | S | 7/1998 | Apps et al. |
| 6,086,128 | A | 7/2000 | Whitehead, Sr. et al. |
| 7,213,793 | B2 | 5/2007 | Sturt et al. |
| 7,281,742 | B2 | 10/2007 | Porter et al. |

(Continued)

FOREIGN PATENT DOCUMENTS

| | | | |
|---|---|---|---|
| DE | 3843287 | A1 * | 6/1990 |
| DE | 102018107578 | A1 | 10/2019 |

(Continued)

OTHER PUBLICATIONS

DE-3843287-A1 Translation (Year: 1990).*

(Continued)

*Primary Examiner* — David J Teitelbaum
(74) *Attorney, Agent, or Firm* — Dority & Manning, P.A.

(57) ABSTRACT

A refrigerator appliance includes a cabinet that defines an opening with a plurality of racks mounted in the cabinet. A door is mounted to the cabinet at the opening. A divider is configured to separate the cabinet into a first cabinet portion and a second cabinet portion. The divider includes an insulation block with a top cover mounted to the insulation block. The top cover includes a top foil heater. Also included in the divider is a bottom cover mounted to the insulation block. The bottom cover includes a bottom foil heater. A plastic extrusion is mounted to a side of the insulation block, and the top cover and the bottom cover include a forming on at least two sides. The forming of the top and bottom covers engages with the plastic extrusion.

16 Claims, 7 Drawing Sheets

(56) References Cited

U.S. PATENT DOCUMENTS

| | | | | |
|---|---|---|---|---|
| D612,211 | S | 3/2010 | Busby | |
| 9,839,289 | B1 | 12/2017 | Stefan et al. | |
| 10,166,928 | B2 | 1/2019 | Loew | |
| 10,441,007 | B2 | 10/2019 | Richards | |
| 10,866,021 | B2 | 12/2020 | Okazaki et al. | |
| 10,918,210 | B2 | 2/2021 | Stefan et al. | |
| 2002/0117949 | A1* | 8/2002 | Banicevic | F25D 23/082 312/407 |
| 2006/0218958 | A1* | 10/2006 | Rand | F25D 11/022 62/302 |
| 2009/0090734 | A1 | 4/2009 | Wittern, Jr. et al. | |
| 2013/0195544 | A1* | 8/2013 | Sanders | E04B 2/56 403/268 |
| 2015/0168048 | A1* | 6/2015 | Sexton | F25D 23/062 62/329 |
| 2017/0030631 | A1* | 2/2017 | Han | G01N 5/02 |

FOREIGN PATENT DOCUMENTS

| | | | | | |
|---|---|---|---|---|---|
| JP | 2020118345 | A | * | 8/2020 | F25D 11/02 |
| KR | 930006414 | B1 | * | 7/1993 | |
| KR | 100985105 | B1 | * | 10/2010 | |
| KR | 20160023449 | A | | 3/2016 | |

OTHER PUBLICATIONS

KR-930006414-B1 Translation (Year: 1993).*
KR-100985105-B1 Translation (Year: 2010).*
JP-2020118345-A Translation (Year: 2020).*

* cited by examiner

SYSTEMS FOR HEAT LEAK PREVENTION IN REFRIGERATOR APPLIANCES

FIELD OF THE INVENTION

The present subject matter relates generally to systems for preventing heat leak in refrigerator appliances, such as wine refrigerators.

BACKGROUND OF THE INVENTION

Wine refrigerators, also called wine coolers, wine reserves, or wine caves, are used to chill wine to a desired storage temperature. Wine refrigerators are sold in a variety of sizes from small to large. Generally, a wine refrigerator can hold wine bottles, like other refrigerator appliances hold food, in low humidity conditions. However, a wine refrigerator is advantageous for wine storage since the appliance can maintain the proper temperature for wine. Other refrigerator appliances typically get opened and closed quite often, which can cause the internal temperature of the refrigerator to fluctuate. Repeated temperature fluctuations can be harmful to bottles of wine. Additionally, wine refrigerators and other refrigerator appliances have different purposes, such as an everyday refrigerator appliance that is meant to keep perishable food items, cold and dry. The temperature for keeping food items cold and dry can be too harsh for the fragile composition of wine.

Wine refrigerators can be used to chill wine to a desired serving temperature, but not all wines are meant to be cooled to the same temperature. In the case where multiple wines are stored in a wine refrigerator, but require different temperatures, a divider can be placed in the wine refrigerator to create two separate chambers. Although, temperature differences between the compartments can lead to issues, such as heat leak and condensation, thus reducing the quality and function of the wine refrigerator.

BRIEF DESCRIPTION OF THE INVENTION

Aspects and advantages of the invention will be set forth in part in the following description, or may be apparent from the description, or may be learned through practice of the invention.

In one example embodiment, a refrigerator appliance includes a cabinet that defines an opening with a plurality of racks mounted in the cabinet. A door is mounted to the cabinet at the opening. The refrigerator appliance also includes a controller. A user interface is mounted to the cabinet and the user interface is configured for signal communication with the controller. Additionally, a divider is configured to separate the cabinet into a first cabinet portion and a second cabinet portion. The divider includes an insulation block with a top cover mounted to the insulation block. The top cover includes a top foil heater. Also included in the divider is a bottom cover mounted to the insulation block. The bottom cover includes a bottom foil heater. A plastic extrusion is mounted to a side of the insulation block, and the top cover and the bottom cover include a forming on at least two sides. The forming of the top and bottom covers engages with the plastic extrusion.

In another example embodiment, a wine cooler appliance includes a cabinet that defines an opening, and a plurality of racks are mounted in the cabinet. A door is mounted to the cabinet at the opening. The refrigerator appliance also includes a controller. A user interface is mounted to the cabinet. The user interface is configured for signal communication with the controller. A divider is configured to separate the cabinet into a first cabinet portion and a second cabinet portion. The divider includes an insulation block including at least two recessed portions. A top divider cover mounted to the insulation block. The top cover includes a top foil heater. A bottom divider cover mounted to the insulation block. The bottom cover includes a bottom foil heater. A plastic extrusion is mounted to a side of the insulation block and the plastic extrusion includes a gasket track. A seal is inserted into the gasket track. The top cover and the bottom cover include a forming on at least two sides. The forming of the top and bottom covers engages with the plastic extrusion.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
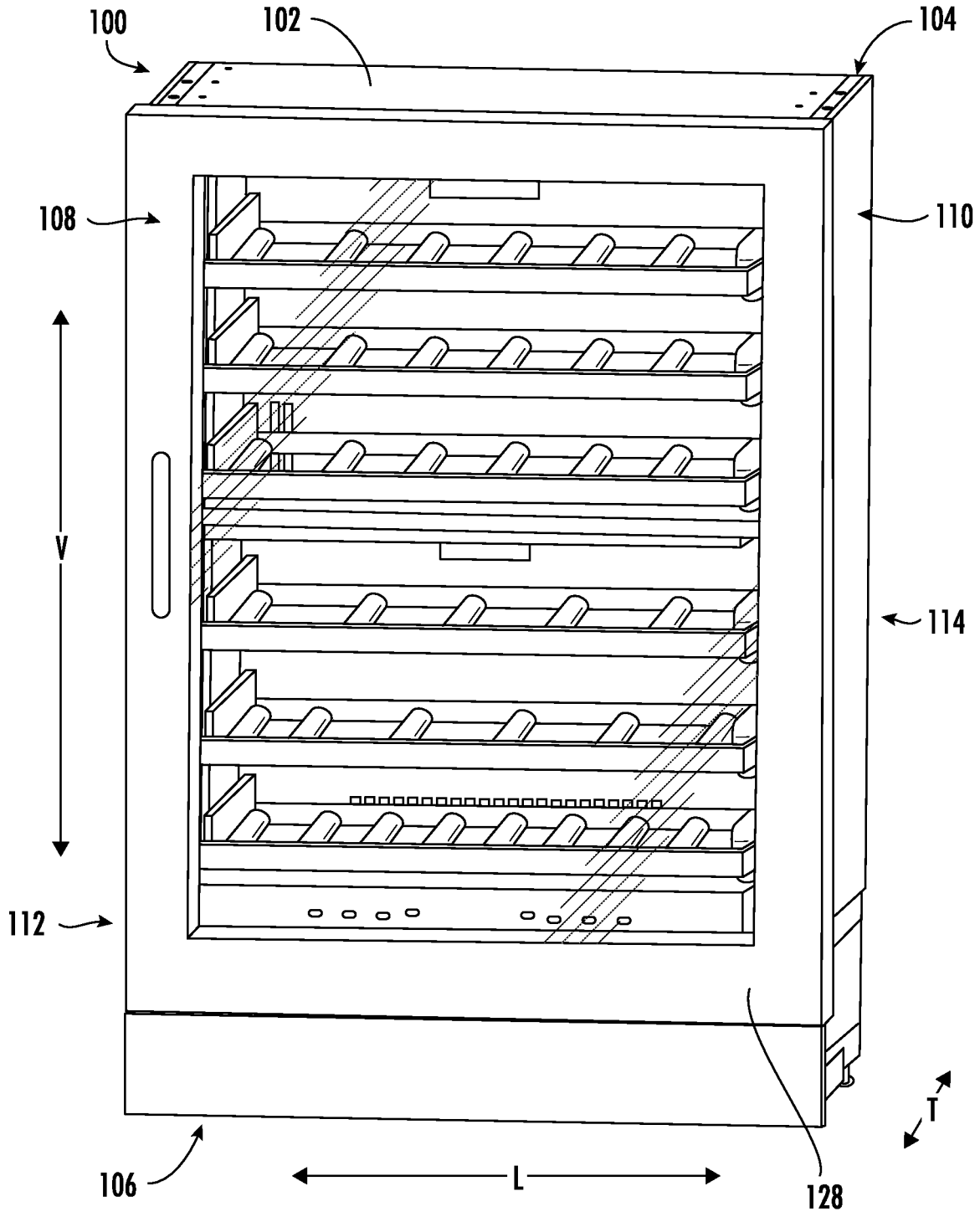
FIG. 1 is a perspective view of a refrigerator appliance according to an example embodiment of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

Figure 2:
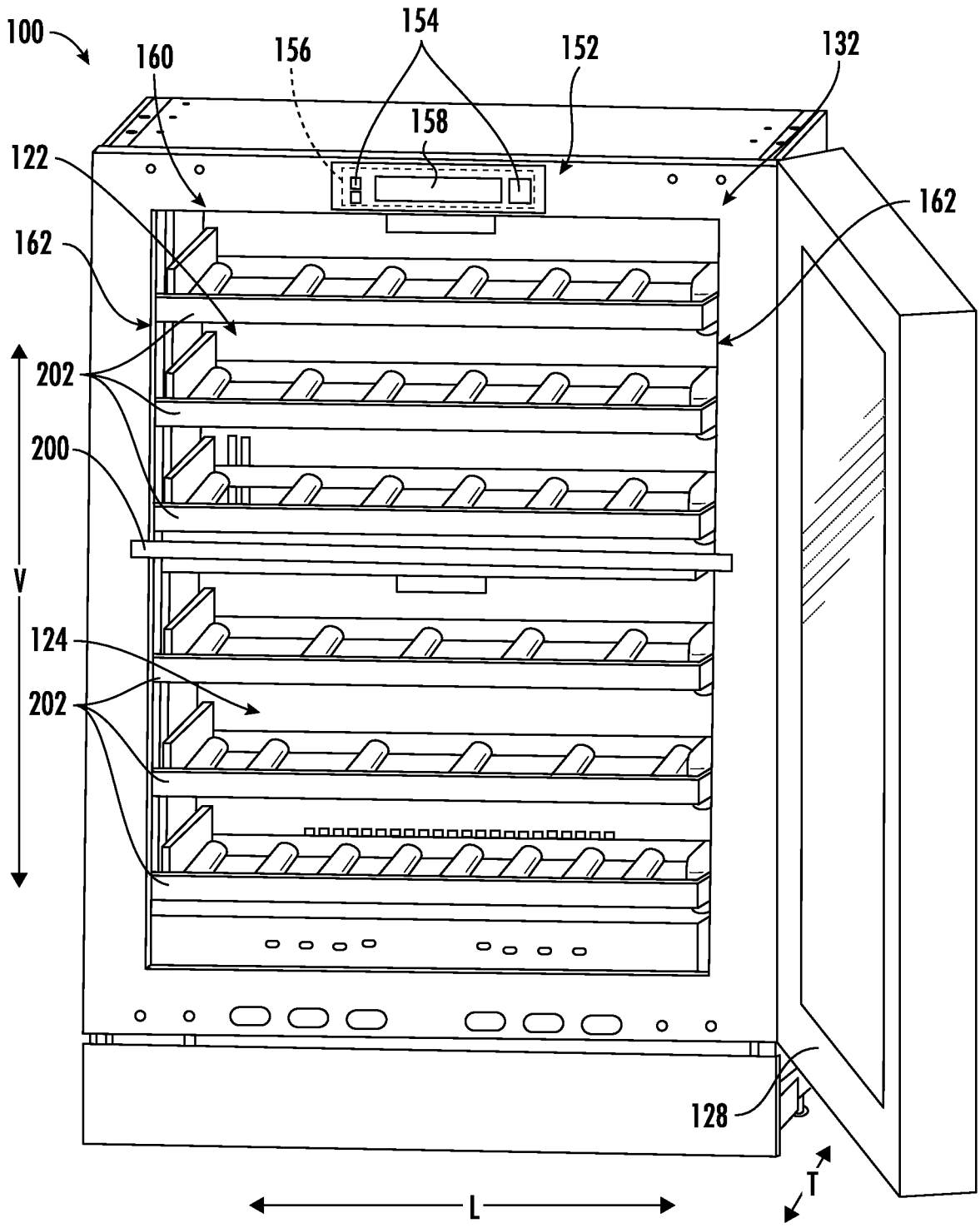
FIG. 2 is a perspective view of the example refrigerator appliance of FIG. 1 with the door shown in an open configuration.

Referring now to the figures, an example appliance will be described in accordance with example aspects of the present subject matter. Specifically, FIG. 1 provides a perspective view of an example refrigerator appliance 100, and FIG. 2 illustrates refrigerator appliance 100 with the door in the open position. As illustrated, refrigerator appliance 100 generally defines a vertical direction V, a lateral direction L, and a transverse direction T that are mutually perpendicular and form an orthogonal coordinate system.

According to example embodiments, refrigerator appliance 100 includes a cabinet 102 that is generally configured for containing and/or supporting various components of refrigerator appliance 100 and which may also define one or more internal chambers or compartments of refrigerator appliance 100. In this regard, as used herein, the terms "cabinet," "housing," and the like are generally intended to refer to an outer frame or support structure for refrigerator appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of refrigerator appliance 100. By contrast, cabinet 102 may enclose some or all portions of an interior of cabinet 102. It should be appreciated that cabinet 102 may have any suitable size, shape, and configuration while remaining within the scope of the present subject matter.

As illustrated, cabinet 102 generally extends between a top portion 104 and a bottom portion 106 along the vertical direction V, between a first side portion 108 (e.g., the left side when viewed from the front as in FIG. 1) and a second side portion 110 (e.g., the right side when viewed from the front as in FIG. 1) along the lateral direction L, and between a front portion 112 and a rear portion 114 along the transverse direction T. In general, terms such as "left," "right," "front," "rear," "top," or "bottom" are used with reference to the perspective of a user accessing refrigerator appliance 100. As shown in FIG. 2, cabinet 102 may include a top wall 160 and a pair of side walls 162, e.g., that are spaced apart along the lateral direction L.

Cabinet 102 defines chilled cabinet portions for receipt of items for storage. In particular, cabinet 102 defines first cabinet portion 122 positioned at or adjacent top portion 104 of cabinet 102 and a second cabinet portion 124 arranged at or adjacent bottom portion 106 of cabinet 102. As such, refrigerator appliance 100 is generally referred to as a wine reserve. Aspects of the present subject matter may be applied to other appliances as well, such as other types of refrigerator appliances. Consequently, the description set forth herein is for illustrative purposes only and is not intended to be limiting in any aspect to any particular refrigerator appliance or configuration.

Door 128 is rotatably hinged to an edge of cabinet 102 for selectively accessing first cabinet portion 122 and second cabinet portion 124. In general, door 128 selectively form a seal over a front opening 132 defined by cabinet 102. In this regard, a user may place items within first cabinet portion 122 and second cabinet portion 124 through front opening 132 when door 128 is open and may then close door 128 to facilitate climate control. Door 128 is shown in the closed configuration in FIG. 1. One skilled in the art will appreciate that other cabinet portions and door configurations are possible and within the scope of the present invention.

FIG. 2 provides a perspective view of refrigerator appliance 100 shown with door 128 in the open position. Separating first cabinet portion 122 and second cabinet portion 124 may be a divider 200. Divider 200 will be described in more detail herein. Also shown in FIG. 2, a plurality of storage rack 202 are mounted within first cabinet portion 122 and second cabinet portion 124 to facilitate storage of wine thereon as will be understood by those skilled in the art. Each of these storage rack 202 are configured for receipt of bottles, e.g., wine bottles, and may assist with organizing such bottles. It should be appreciated that the illustrated storage racks 202 are used only for the purpose of explanation and that other storage components may be used and may have different sizes, shapes, and configurations.

A control panel 152 is provided for controlling the mode of operation, such as the temperature of first cabinet portion 122 and second cabinet portion 124. For example, control panel 152 includes one or more selector inputs 154, such as buttons, touchscreen interfaces, etc. In this regard, inputs from control panel 152 may be in communication with a processing device or controller 156. Signals generated in controller 156 operate refrigerator appliance 100 in response to selector inputs 154. Additionally, a display 158, such as an indicator light or a screen, may be provided on control panel 152. Display 158 may be in communication with controller 156, and may display information in response to signals from controller 156.

As used herein, "processing device" or "controller" may refer to one or more microprocessors or semiconductor devices and is not restricted necessarily to a single element. The processing device can be programmed to operate refrigerator appliance 100 and other components of refrigerator appliance 100. The processing device may include, or be associated with, one or more memory elements (e.g., non-transitory storage media). In some such embodiments, the memory elements include electrically erasable, programmable read only memory (EEPROM). Generally, the memory elements can store information accessible by a processing device, including instructions that can be executed by processing device. Optionally, the instructions can be software or any set of instructions and/or data that when executed by the processing device, cause the processing device to perform operations. Controller 156 may be in operative communication with a sealed system (not shown) within cabinet 102 that is operable to cool first and second cabinet portions 122, 124. Such systems will be well understood by those skilled in the art and are not described in detail herein for the sake of brevity.

Figure 3:
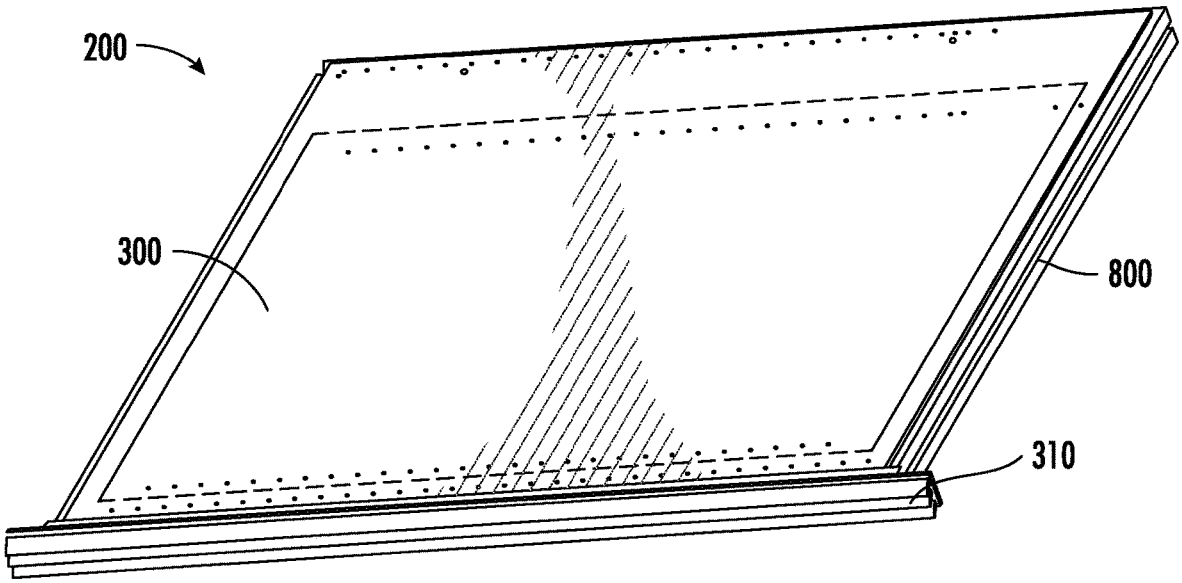
FIG. 3 is a perspective view of a divider of the example refrigerator appliance of FIG. 1.

FIG. 3 illustrates divider 200. When installed within cabinet 102, divider 200 may create a seal between first cabinet portion 122 and second cabinet portion 124. With divider 200 sealing first cabinet portion 122 and second cabinet portion 124, each cabinet portion 122, 124 may independently regulate temperature, e.g., first cabinet portion 122 and second cabinet portion 124 may have different temperatures for storing different types of wine. As shown in FIG. 3, divider 200 may include a door seal 310, for sealing the space between divider 200 and door 128 when door 128 is closed. Door seal 310 may be a gasket insert or a flap door seal, or any other suitable type of seal that may extend across and block a gap between divider 200 and door 128 when door 128 is closed.

Figure 4:
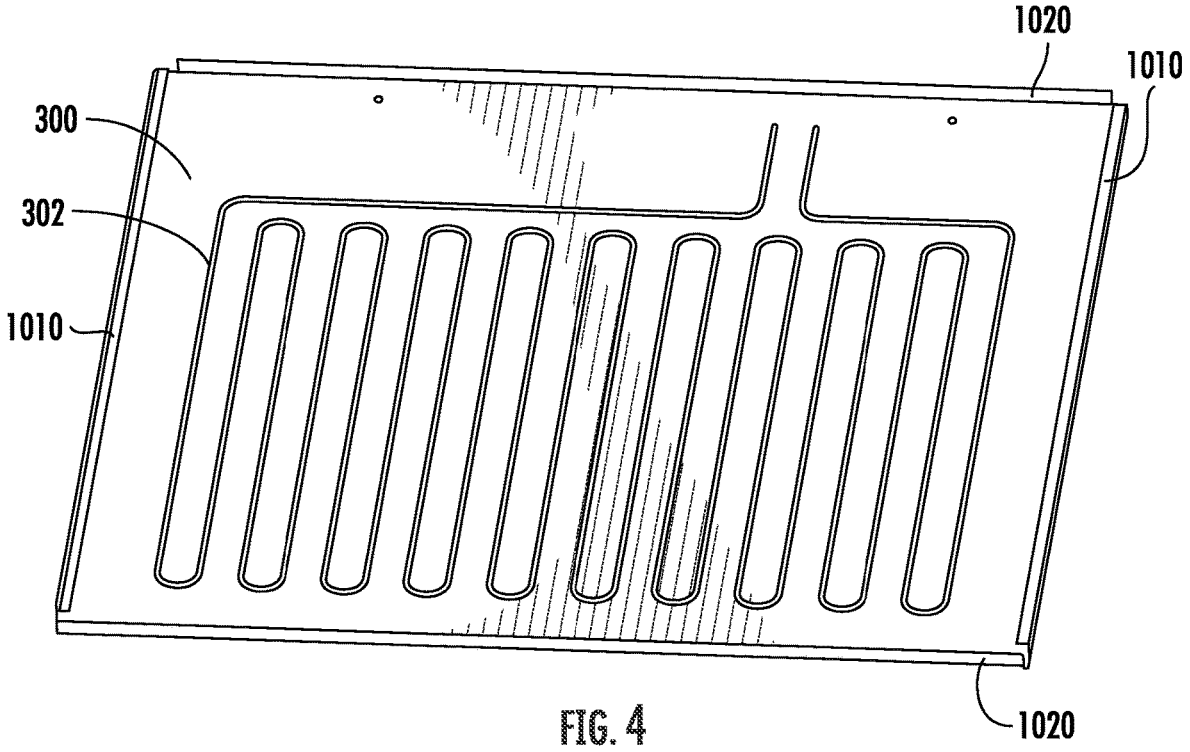
FIGS. 4 and 5 are perspective views of a top and bottom cover, respectively, of the example divider of FIG. 3.
Figure 5:
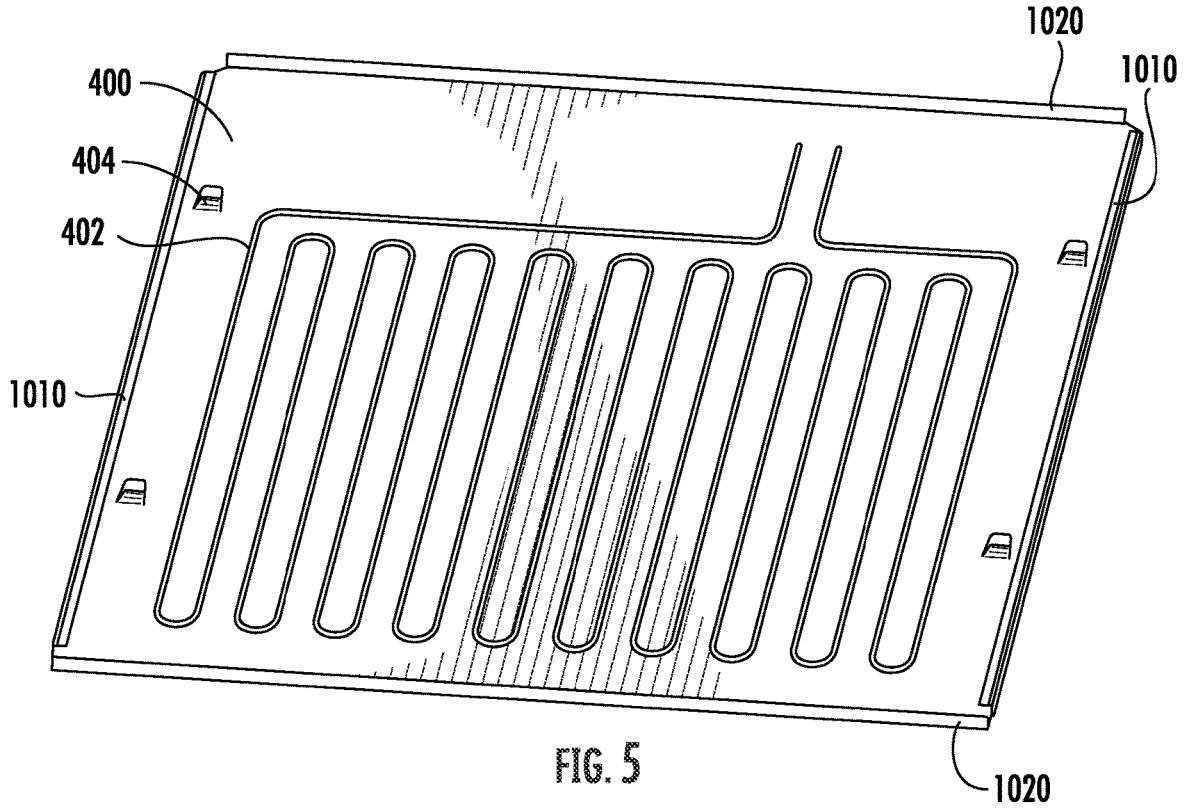

FIGS. 4-9 illustrate various components of divider 200. As seen in FIG. 4, a top cover 300 may include a top foil heater 302, such as an electric resistance heating element. Likewise, as may be seen in FIG. 5, a bottom cover 400 may include a bottom foil heater 402, such as an electric resistance heating element. Bottom cover 400 may also include a clasp 404. In some example embodiments there may be a plurality of clasps 404. A user may slide divider 200 into position within refrigerator appliance 100, and clasp 404 may restrain movement of divider 200, e.g., along the vertical direction V. Top foil heater 302 and bottom foil heater 402 may provide an individual heat source to each of the individual cabinet portions 122, 124, respectively. For example, controller 156 may selectively operate top foil heater 302 and bottom foil heater 402 to regulate the temperate within first and second cabinet portions 122, 124, respectively. Top cover 300 and bottom cover 400 may be made of any suitable metal. Additionally, top cover 300 and bottom cover 400 may not come into contact with one another and may be thermally separated. Moreover, divider 200 may not include any metal fasteners, e.g., screws, bolts, that extend between and couple top and bottom covers 300, 400 to aid in the prevention of heat leak and to improve assembly.

Figure 6:
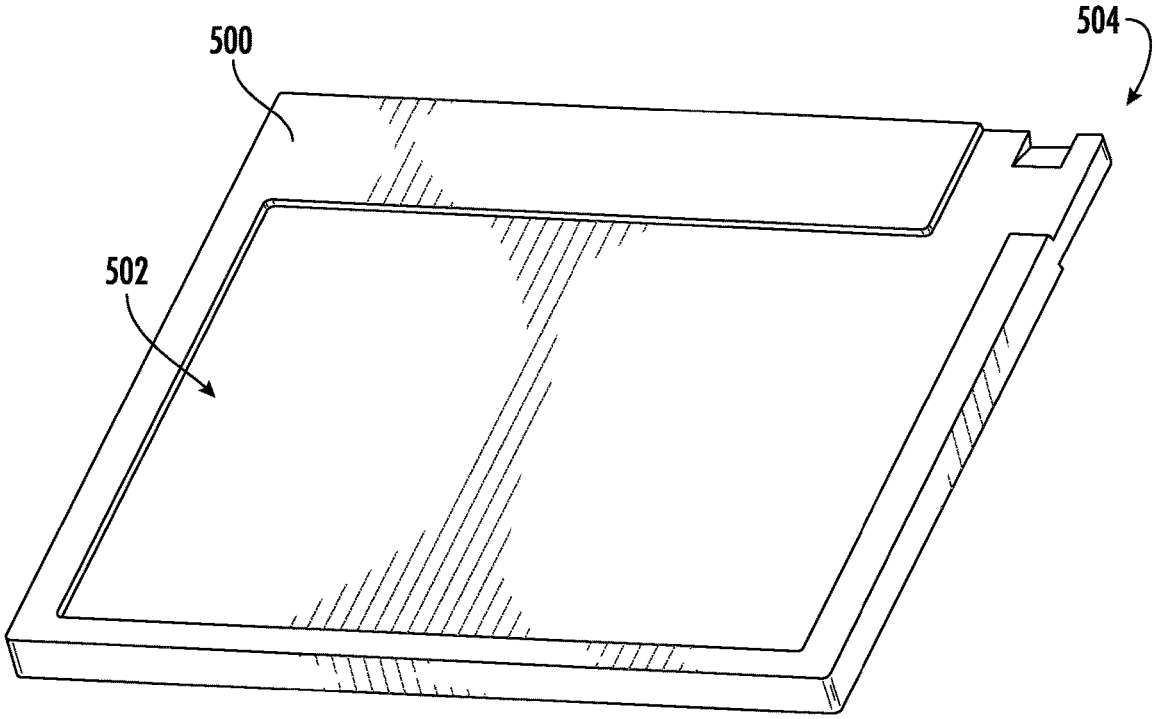
FIGS. 6 and 7 are perspective views of an insulation block of the example divider of FIG. 3.
Figure 7:
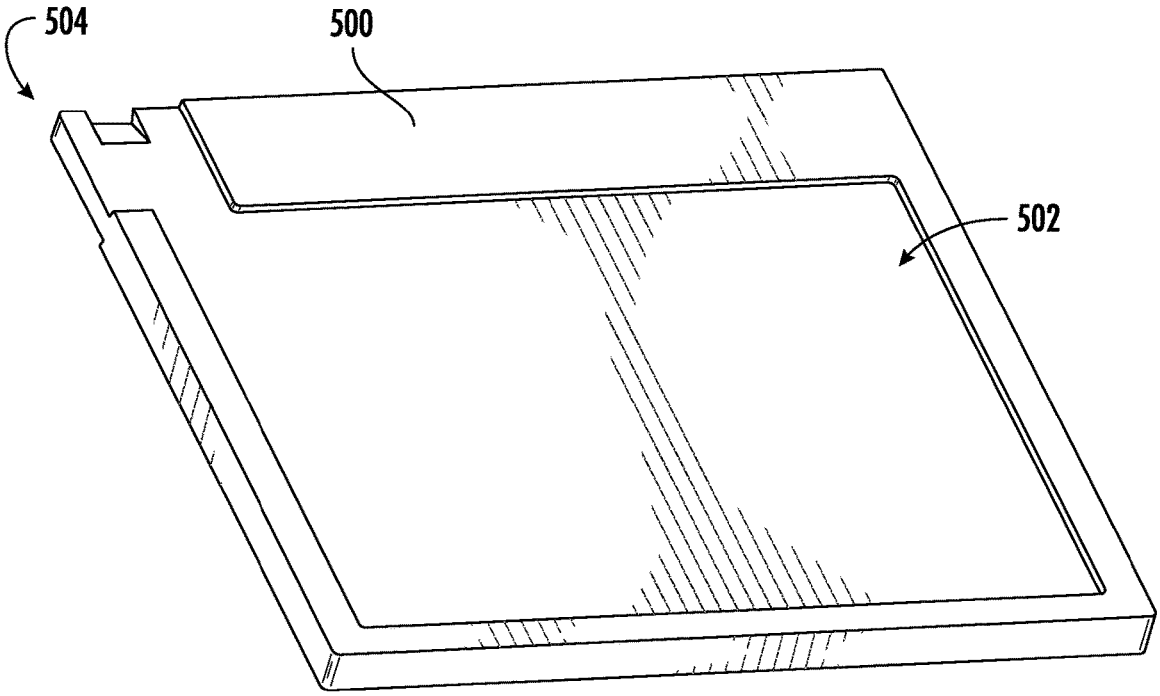

FIGS. 6 and 7 illustrates an insulation block 500 with a recessed or indented portion 502. Additionally, a wire slot 504 may be included at one corner of the indented portion 502. Insulation block 500 may be an expanded polystyrene (EPS) block. In other example embodiments, insulation block 500 may be other forms of suitable insulation, such as injected polyurethane foam, vacuum panel, EPS block, any other suitable insulating material, or combinations thereof. Insulation block 500 may be configured for thermally separating and insulating between top cover 300 and bottom cover 400. Moreover, insulation block 500 may be positioned between and separate top and bottom covers 300, 400, e.g., in order to limit conductive heat transfer between top and bottom covers 300, 400. As may be seen in FIGS. 6 and 7, indented portion 502 may be mirrored from one side of insulation block 500 to the other side, such as to line up wire slot 504 on each side. Indented portion 502 and wire slot 504 may be configured for the receipt of the top foil heater 302 and bottom foil heater 402, i.e., indented portion 502 may correspond to or complement the shape of a foil heater.

Figure 8:
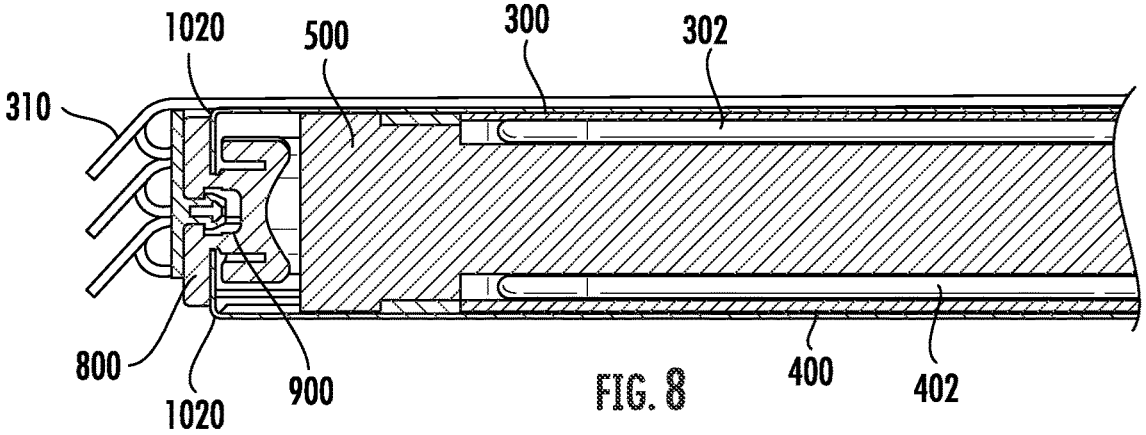
FIGS. 8 and 9 are side, section views of the divider of FIG. 3.
Figure 9:
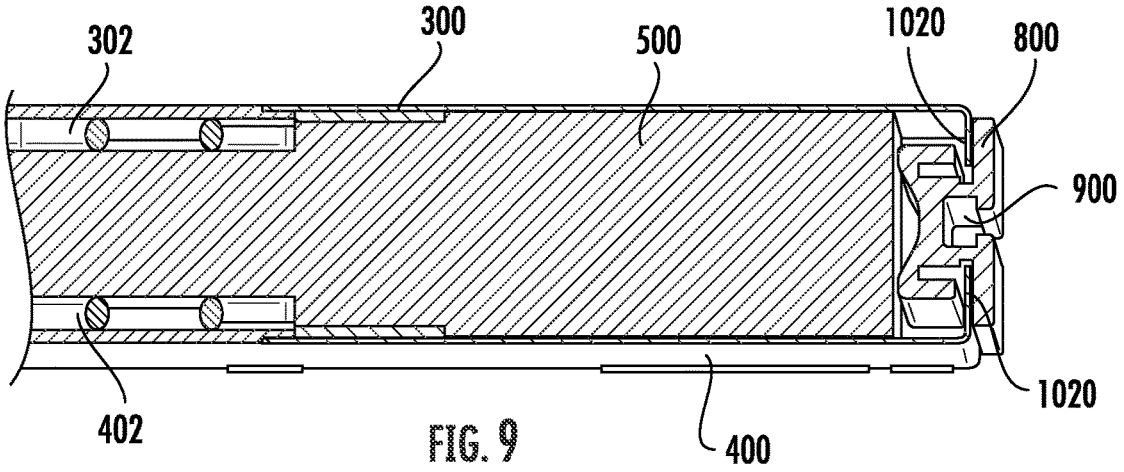
Figure 10:
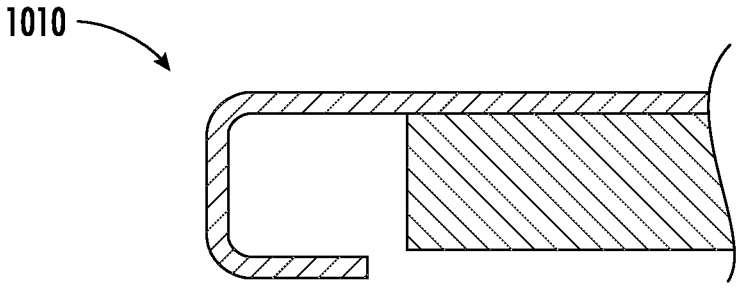
FIGS. 10 and 11 are detail views of the edge formations of the top and bottom cover of FIGS. 4 and 5.
Figure 11:
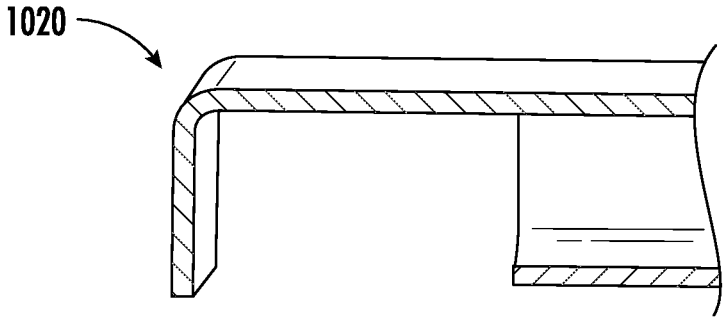

FIGS. 8 and 9 illustrate a common profile plastic extrusion 800. Common profile plastic extrusion 800 may be used on each side of insulation block 500 to create a frame for holding divider 200 together. Common profile plastic extrusion 800 may include a gasket track 900 which may be used to hold door seal 310 and/or additional seals around divider 200. FIGS. 10 and 11 illustrate shapes formed into the edges of top cover 300 and bottom cover 400 used to hold divider 200 together with common profile plastic extrusion 800. FIG. 10 shows a U-shaped forming 1010 which may be used on the sides of each cover 300, 400 parallel to the pair of side walls 162. U-shaped forming 1010 may be used to restrain divider 200 components, e.g., along one or both of the lateral direction L and the vertical direction V, when received within corresponding slots in common profile plastic extrusion 800. FIG. 11 shows a L-shaped forming 1020 which may be used on the sides of each cover perpendicular to the pair of side walls 162. L-shaped forming may be used to restrain divider 200 components, e.g., along the transverse direction T, when received within corresponding slots in common profile plastic extrusion 800. Sides with the same forming may be on opposing sides from one another, e.g., such that two sides with the same shaped forming are not adjacent. Common profile plastic extrusion 800 may thus couple top and bottom covers 300, 400 together, e.g., without fasteners, to form divider 200. In other example embodiments, such as where insulation block 500 is injected polyurethane, covers 300 and 400 may not include U-shaped forming 1010 and L-shaped forming 1020 since the foaming fixture and foam adherence may secure the top, bottom and sides of divider 200 to one another.

As may be seen above, a refrigerator appliance 100 may include a divider 200 that may provide a heat source independently to a first and second cabinet portion 122 and 124, respectively. Divider 200 may also insulate and seal between first cabinet portion 122 and second cabinet portion 124. Additionally, since divider 200 may not include metal fasteners, divider 200 may permit less heat leak than an embodiment that does include metal fasteners.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet defining an opening, a plurality of racks mounted in the cabinet, a door mounted to the cabinet at the opening;

a controller;

a user interface mounted to the cabinet, the user interface configured for signal communication with the controller; and a divider configured to separate the cabinet into a first cabinet portion and a second cabinet portion, the divider comprising an insulation block, a top cover mounted to the insulation block, the top cover comprising a top foil heater, a bottom cover mounted to the insulation block, the bottom cover comprising a bottom foil heater, and a plastic extrusion mounted to a side of the insulation block, wherein the top cover and the bottom cover each comprise a forming on at least two sides, the forming of the top and bottom covers engaging the plastic extrusion, wherein the forming of the top cover and the bottom cover are on at least two opposing sides of the top cover and the bottom cover, and the forming is u-shaped to restrict movement along two perpendicular directions, and wherein the u-shaped forming of the top cover and the bottom cover are on at least two opposing sides of the top cover and the bottom cover, and the other opposing sides of the top cover and the bottom cover comprises an L-shaped forming to restrict movement another direction that is perpendicular to the two perpendicular directions.

2. The refrigerator appliance of claim 1, wherein the top cover and the bottom cover each comprise a metal panel.

3. The refrigerator appliance of claim 1, wherein the insulation block is an expanded polystyrene (EPS) block.

4. The refrigerator appliance of claim 1, wherein the insulation block defines at least two recessed portions, a shape of each of the recessed portion complementary to the foil heater of the top cover and the bottom cover.

5. The refrigerator appliance of claim 1, further comprising a gasket track in the plastic extrusion.

6. The refrigerator appliance of claim 5, further comprising a door seal mounted to the gasket track of the plastic extrusion.

7. The refrigerator appliance of claim 6, wherein the door seal is a gasket insert or a flap door seal inserted into the gasket track of the plastic extrusion.

8. The refrigerator appliance of claim 1, further comprising a plurality of clasps formed on the bottom cover.

9. The refrigerator appliance of claim 6, wherein the divider selectively forms a seal between the first cabinet portion and the second cabinet portion.

10. A wine cooler appliance, comprising:

a cabinet, defining an opening, a plurality of racks mounted in the cabinet, a door mounted to the cabinet at the opening;

a controller;

a user interface mounted to the cabinet, the user interface configured for signal communication with the controller; and a divider configured to separate the cabinet into a first cabinet portion and a second cabinet portion, the divider comprising, an insulation block comprising at least two recessed portion;

a top divider cover, mounted to the insulation block, the top cover comprising a top foil heater, a bottom divider cover, mounted to the insulation block, the bottom cover comprising a bottom foil heater, and a plastic extrusion mounted to a side of the insulation block, the plastic extrusion comprising a gasket track, a seal inserted into the gasket track, wherein the top cover and the bottom cover each comprise a forming on at least two sides, the forming of the top and bottom covers engaging the plastic extrusion, wherein the forming of the top cover and the bottom cover are on at least two opposing sides of the top cover and the bottom cover, and the forming is u-shaped to restrict movement along two perpendicular directions, and wherein the u-shaped forming of the top cover and the bottom cover are on at least two opposing sides of the top cover and the bottom cover, and the other opposing sides of the top cover and the bottom cover comprises an L-shaped forming to restrict movement another direction that is perpendicular to the two perpendicular directions.

11. The wine cooler appliance of claim 10, wherein the top cover and the bottom cover each comprise a metal panel.

12. The wine cooler appliance of claim 10, wherein the insulation block is an expanded polystyrene (EPS) block.

13. The wine cooler appliance of claim 10, wherein the insulation block defines at least two recessed portions, a shape of each of the recessed portion complementary to the foil heater of the top cover and the bottom cover.

14. The wine cooler appliance of claim 10, wherein the seal is a gasket insert or a flap door seal inserted into the gasket track of the plastic extrusion.

15. The wine cooler appliance of claim 10, further comprising a plurality of clasps formed on the bottom cover.

16. The wine cooler appliance of claim 10, wherein the divider selectively forms a seal between the first cabinet portion and the second cabinet portion.

* * * * *